US009819071B2

(12) United States Patent
Nguyen

(10) Patent No.: US 9,819,071 B2
(45) Date of Patent: Nov. 14, 2017

(54) ANTENNA APPARATUS AND METHOD OF MAKING SAME

(75) Inventor: Anthony Nguyen, San Diego, CA (US)

(73) Assignee: NOKIA TECHNOLOGIES OY, Espoo (FI)

( * ) Notice: Subject to any disclaimer, the term of this patent is extended or adjusted under 35 U.S.C. 154(b) by 334 days.

(21) Appl. No.: 14/422,528

(22) PCT Filed: Aug. 20, 2012

(86) PCT No.: PCT/IB2012/054213
§ 371 (c)(1),
(2), (4) Date: Jun. 10, 2015

(87) PCT Pub. No.: WO2014/030031
PCT Pub. Date: Feb. 27, 2014

(65) Prior Publication Data
US 2016/0013543 A1 Jan. 14, 2016

(51) Int. Cl.
*H01Q 1/24* (2006.01)
*H01Q 9/42* (2006.01)
(Continued)

(52) U.S. Cl.
CPC ..... *H01Q 1/243* (2013.01); *H01Q 9/42* (2013.01); *H01Q 21/0087* (2013.01); *H01Q 21/30* (2013.01)

(58) Field of Classification Search
CPC ..... H01Q 1/243; H01Q 1/38; H01Q 13/10; H01Q 9/0421; H01Q 1/42; H01Q 1/36
(Continued)

(56) References Cited

U.S. PATENT DOCUMENTS 8,638,262 B2 * 1/2014 Arkko ..... H01Q 1/243 343/702
2003/0186728 A1 10/2003 Manjo
(Continued)

FOREIGN PATENT DOCUMENTS

CN 102593578 A 7/2012
EP 1324425 A1 7/2003
(Continued)

OTHER PUBLICATIONS

Office action received for corresponding Chinese Patent Application No. 201280075331.0, dated Oct. 11, 2016, 4 pages of office action and 3 pages of office action translation available.
(Continued)

*Primary Examiner* — Linh Nguyen
(74) *Attorney, Agent, or Firm* — Nokia Technologies Oy

(57) ABSTRACT

A housing defines a face bounded by opposed longitudinal and opposed lateral sidewalls. At least one conductive portion of at least one longitudinal sidewall is electrically isolated from at least one conductive portion of at least one of the lateral sidewalls by at least one corner section that is non-conductive or electrically floating. At least one antenna element internal to the housing is electrically coupled to radio frequency circuitry; and a conductor configured to electrically couple the at least one conductive portion of the at least one lateral sidewall between the opposed longitudinal portions to a ground plane. In a specific embodiment, there are two opposed corner sections each defined by first and second gaps, and the lateral conductive portion between the corner sections parasitically couples to the antenna element when transmitting or receiving. The corner sections may each have a corner conductive portion which are isolated by the gaps.

20 Claims, 7 Drawing Sheets

(51) Int. Cl.
*H01Q 21/00* (2006.01)
*H01Q 21/30* (2006.01)

(58) Field of Classification Search
USPC ..... 343/700 MS, 702
See application file for complete search history.

(56) References Cited

U.S. PATENT DOCUMENTS

| | | | | |
|---|---|---|---|---|
| 2006/0192724 | A1 | 8/2006 | Kezys et al. | |
| 2008/0316115 | A1 | 12/2008 | Hill et al. | |
| 2009/0153407 | A1 | 6/2009 | Zhang et al. | |
| 2010/0123632 | A1 | 5/2010 | Hill et al. | |
| 2011/0133995 | A1* | 6/2011 | Pascolini | H01Q 7/00 343/702 |
| 2011/0241948 | A1 | 10/2011 | Bevelacqua et al. | |
| 2012/0009983 | A1 | 1/2012 | Mow et al. | |
| 2012/0112970 | A1* | 5/2012 | Caballero | H01Q 1/243 343/702 |
| 2012/0157175 | A1* | 6/2012 | Golko | G06F 1/1698 455/575.7 |
| 2012/0169547 | A1 | 7/2012 | Oh et al. | |
| 2014/0333486 | A1* | 11/2014 | Greetis | H01Q 1/52 343/702 |
| 2015/0200463 | A1* | 7/2015 | Heikura | H01Q 1/245 455/73 |
| 2015/0280312 | A1* | 10/2015 | Poggio | H01Q 1/243 343/702 |

FOREIGN PATENT DOCUMENTS

| | | | |
|---|---|---|---|
| EP | 1555714 | A1 | 7/2005 |
| EP | 2109230 | A1 | 10/2009 |
| EP | 2597724 | A1 | 5/2013 |

OTHER PUBLICATIONS

"Verizon iPhone 4 Appears to Solve Death Grip", Mobile Venue, Retrieved on Mar. 12, 2016, Webpage available at http://www.mobilevenue.com/verizon-iphone-4-appears-solve-death-grip-01120832/.

Office action received for corresponding Chinese Patent Application No. 201280075331.0, dated Dec. 11, 2015, 5 pages of office action and 5 pages of office action translation available.

Office action received for corresponding Korean Patent Application No. 2015-7006918, dated Feb. 1, 2016, 6 pages of office action and No page of office action translation available.

Office action received for corresponding Japanese Patent Application No. 2015-527031, dated Feb. 17, 2016, 3 pages of office action and No page of office action translation available.

Extended European Search Report received for corresponding European Patent Application No. 12883365.4, dated Mar. 8, 2016, 6 pages.

International Search Report and Written Opinion received for corresponding Patent Cooperation Treaty Application No. PCT/IB2012/054213, dated May 13, 2013, 10 pages.

* cited by examiner

ANTENNA APPARATUS AND METHOD OF MAKING SAME

RELATED APPLICATION

This application was originally filed as Patent Cooperation Treaty Application No. PCT/IB2012/054213 filed Aug. 20, 2012.

TECHNICAL FIELD

The example and non-limiting embodiments of this invention relate generally to antennas for wireless communications including methods and devices therefore, and more specifically relate to conductive strips mounted external of or forming a part of a device housing for use with or as an antenna.

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Antenna design and layout in mobile radio devices, particularly handheld radio devices, has become quite challenging as consumers expect a greater number of radios in a single device to support one or more cellular access technologies, wireless local area networking, global positioning systems and the like. Closely packed electronics are subject to interference with one another, and if antennas are not properly laid out and isolated from one another, the antenna efficiency of one or more antenna can be impacted. But the increasing number of antennas in handheld devices leaves fewer options for the overall layout.

To this end there have been recent attempts to utilize a conductive strip about the exterior of the handset housing to improve antenna performance. But external conductive elements are subject to interference by the user's hand, which in a worst case scenario can de-tune the overall antenna structure so that the antenna goes off frequency, causing an ongoing call to drop.

Using some or all of a mobile device's external housing as an antenna radiator requires there to be one or more non-conductive slots to be formed in the conductive housing to create the radiating element. One slot may provide one end of the radiator where the radio frequency feed line may be placed. The other end of the radiator may be left open due to a second slot or that end may be grounded so as to provide a single-ended loop antenna, with or without a second slot. However, a slot at one end of the radiator can be bridged by the user's hand and detune the antenna causing a dropped call.

Embodiments of these teachings improve upon such external antenna elements.

SUMMARY

In a first aspect the exemplary embodiments of the invention provide an apparatus comprising a housing defining a face bounded by opposed longitudinal sidewalls and opposed lateral sidewalls. At least one conductive portion of at least one of the longitudinal sidewalls is electrically isolated from at least one conductive portion of at least one of the lateral sidewalls by at least one corner section that is non-conductive or electrically floating. The apparatus further comprises at least one antenna element internal to the housing, which is configured to electrically couple to radio frequency circuitry. And the apparatus further includes a conductor configured to electrically couple the at least one conductive portion of the lateral sidewall between the opposed longitudinal sidewalls to a ground plane.

In a second aspect the exemplary embodiments of the invention include a method comprising: providing a housing defining a face bounded by opposed longitudinal sidewalls and opposed lateral sidewalls, wherein at least one conductive portion of at least one of the longitudinal sidewalls is electrically isolated from at least one conductive portion of at least one of the lateral sidewalls by at least one corner section that is non-conductive or electrically floating. Further in the method, at least one antenna element internal to the housing is configured to electrically couple to radio frequency circuitry; and a conductor is disposed to electrically couple the at least one conductive portion of the at least one lateral sidewall between the opposed longitudinal sidewalls to a ground plane.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

DETAILED DESCRIPTION

Embodiments of these teachings generally relate to antennas which utilize a conductive housing for transmitting and receiving radio signals. In some, but not necessarily all embodiments, one or more conductive portions of the housing may be external to the portable electronic device, in other words, forming part of an external surface of the device. Alternatively one or more conductive portions of the housing may be internal to the portable electronic device, in other words integrated within the housing wall or integrated on an inner surface of the housing wall, the external surface of the device comprising non-conductive material. In other embodiments the housing wall may be entirely conductive throughout its cross-section. Such an external conductive housing is sometimes referred to as a bezel or a metal strip, and in the non-limiting embodiments detailed below such an external conductive housing runs about the periphery of the housing of a mobile terminal or other handheld radio device. This conductive strip may form the actual sidewalls of the housing at the relevant portions or may be mounted to, affixed to or patterned on another material that operates as the structural sidewall. From the exterior the conductive strip may appear from the exterior of the device to be a bezel or a thin strip which runs around the perimeter sidewall of the device, but in fact could also be fully welded or otherwise coupled to an internal sheet metal or extruded part which forms a skeleton of the device to which other components such as molded plastic, speakers and/or buttons are attached. The antenna radiator parts which are either attached at one end to this conductive body/strip or completely isolated from it by having non-conductive gaps therebetween are therefore the separate conductive elements of the external housing. The conductive housing may also be molded within (embedded) a plastic frame so that the conductive housing is not visible from the interior or exterior of the device.

In these teachings the conductive strip may circumscribe the entire device housing (excepting the non-conducting gaps to be detailed below), or it may circumscribe only a portion of the entire device housing. While the examples detail the conductive strip is disposed along a bottom lateral sidewall of the device housing such as adjacent to where a microphone might be disposed, these teachings are readily extendable to disposing the strip along a top lateral sidewall such as adjacent to where a speaker might be disposed.

Figure 1A:
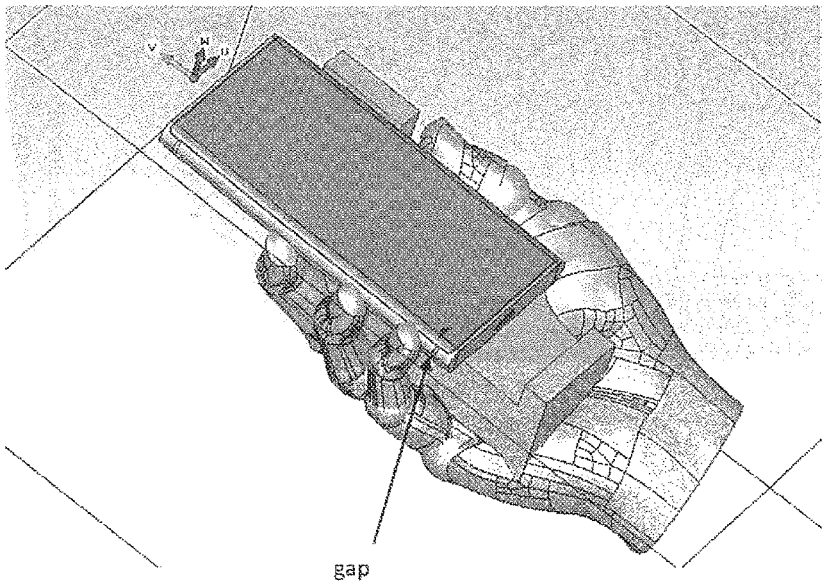
FIG. 1A is a schematic perspective view of a mobile terminal with a gap in the antenna element along the longitudinal sidewalls where the user's hand is away from the gaps and not adversely affecting efficiency of the antenna element.
Figure 1B:
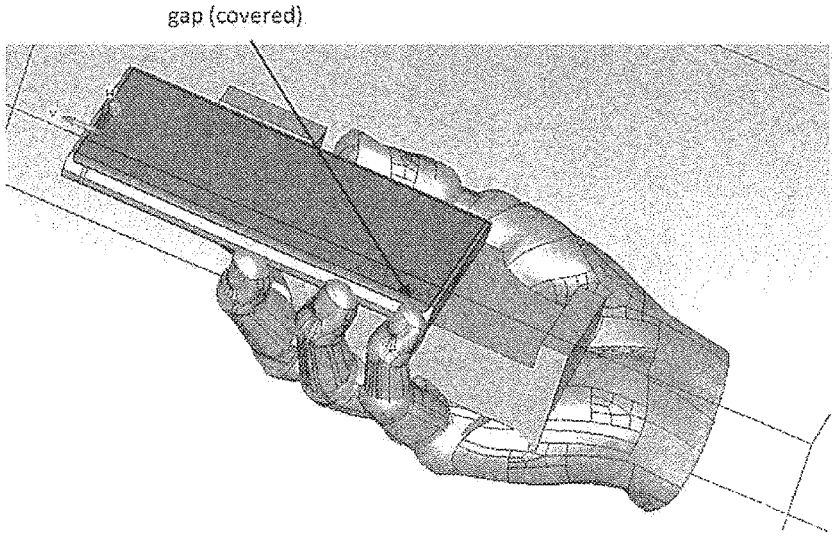
FIG. 1B is similar to FIG. 1A but with the user's hand bridging one of the gaps and adversely affecting the antenna performance.
Figure 3:
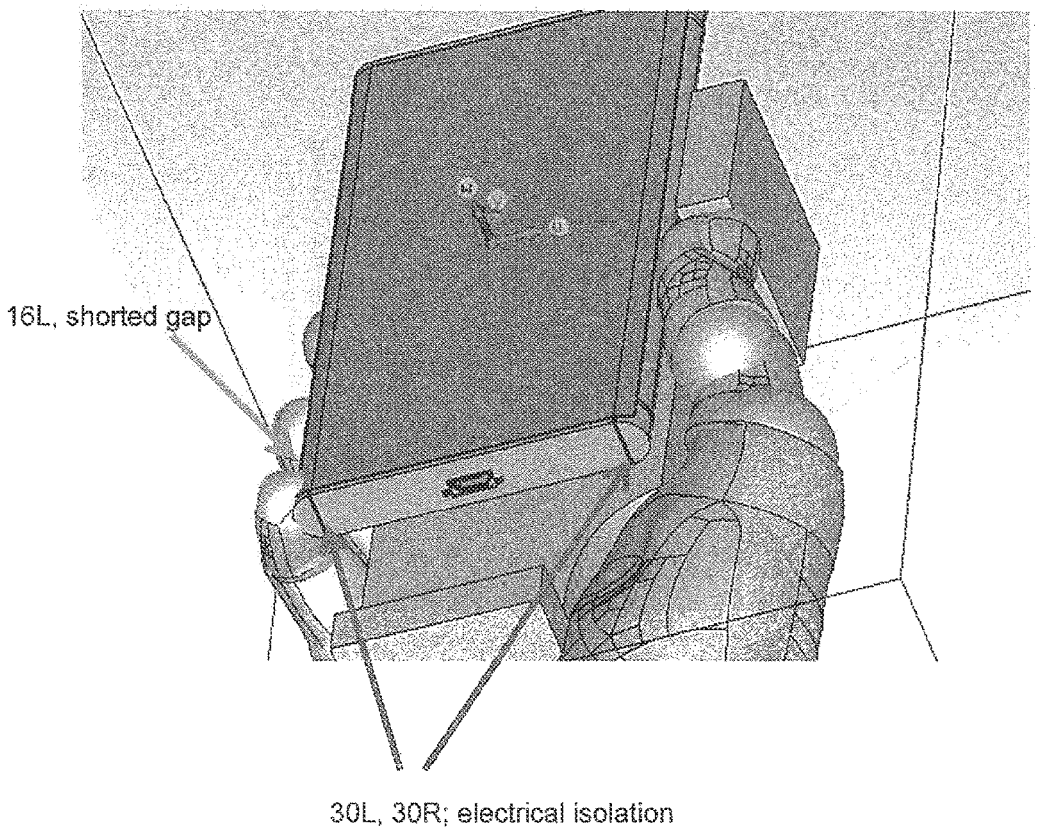
FIG. 3 shows a mobile terminal such as those at FIGS. 2A-B and illustrating the increased isolation enabled by the additional two gaps such that a user's hand bridging the longitudinal gap does not de-tune the antenna, according to an exemplary embodiment of these teachings.

FIGS. 1A-B illustrate a prior art mobile terminal in a user's hand. Note that the block between the user's hand and the mobile terminal at FIGS. 1A-B and also FIG. 3 is a computer-generated artifact to ensure proper positioning of the terminal. The device has antenna elements formed as an exterior metal strip running along the lower lateral sidewall which lies in the user's palm. There is a gap along each longitudinal sidewall to isolate the operative lateral sidewall from interference by the user's hand. Internal of the handset the metal strips along the longitudinal portions are coupled to ground. At FIG. 1A the user is holding the device such that the gap along the left sidewall is visible, and the antenna element that is the lateral portion of the metal strip can operate as intended. At FIG. 1B the user's finger bridges the left gap and effectively shorts the antenna, which is the lateral sidewall portion of the metal strip, to the grounded longitudinal portion. Antenna performance may be acceptable when the mobile terminal is held as in FIG. 1A but is degraded when the user's hand bridges the gap as illustrated in FIG. 1B.

Figure 2A:
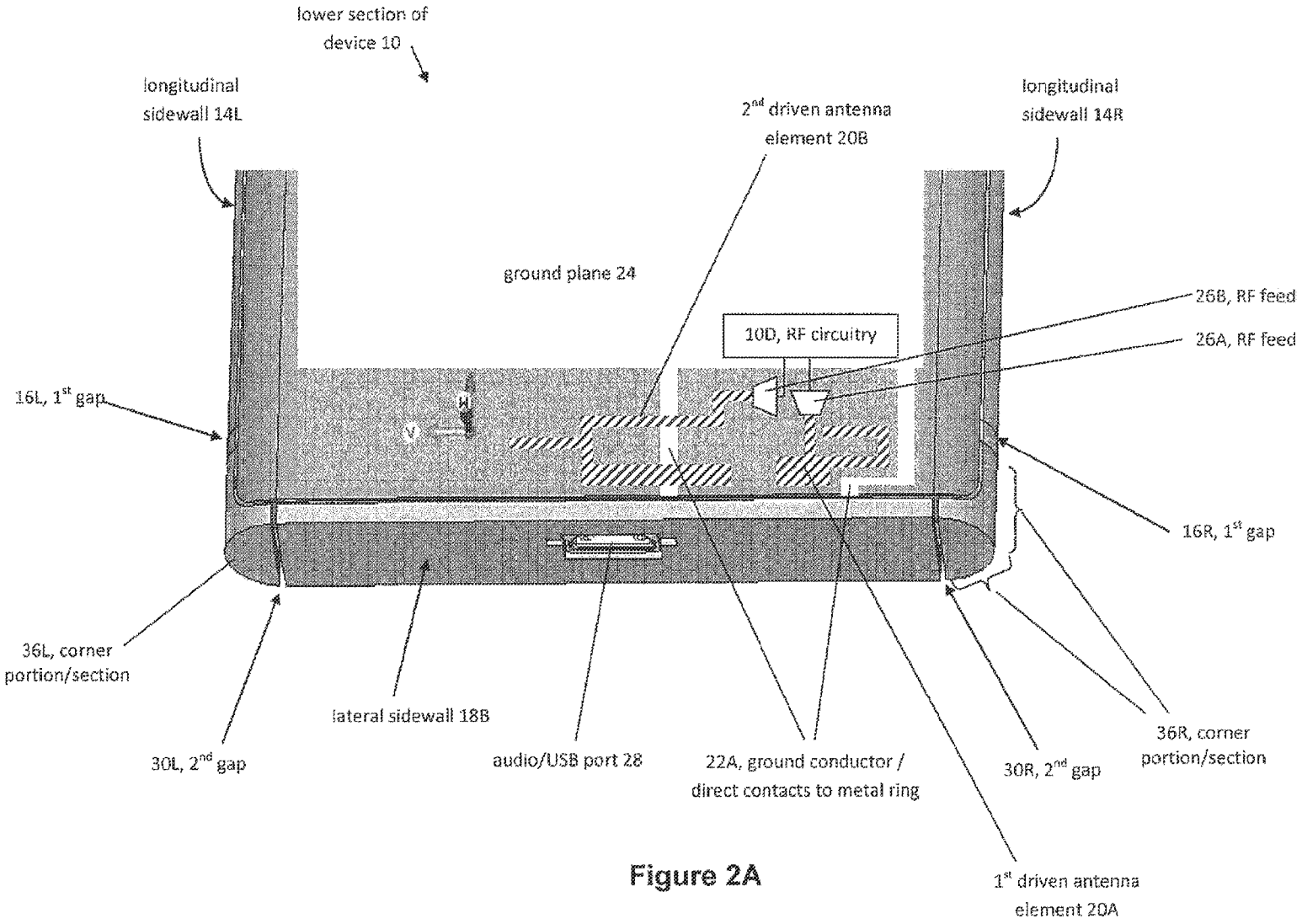
FIG. 2A is a cutaway plan view of a lower portion of a mobile terminal with two internal driven (or fed) antenna elements and an external conductive strip with gaps along the longitudinal sidewalls and additionally two gaps along one lateral sidewall such that a portion of the lateral sidewall between the gaps is a parasitic element that is directly connected to ground and parasitically coupled to the driven antenna elements, according to an exemplary embodiment of these teachings.
Figure 6:
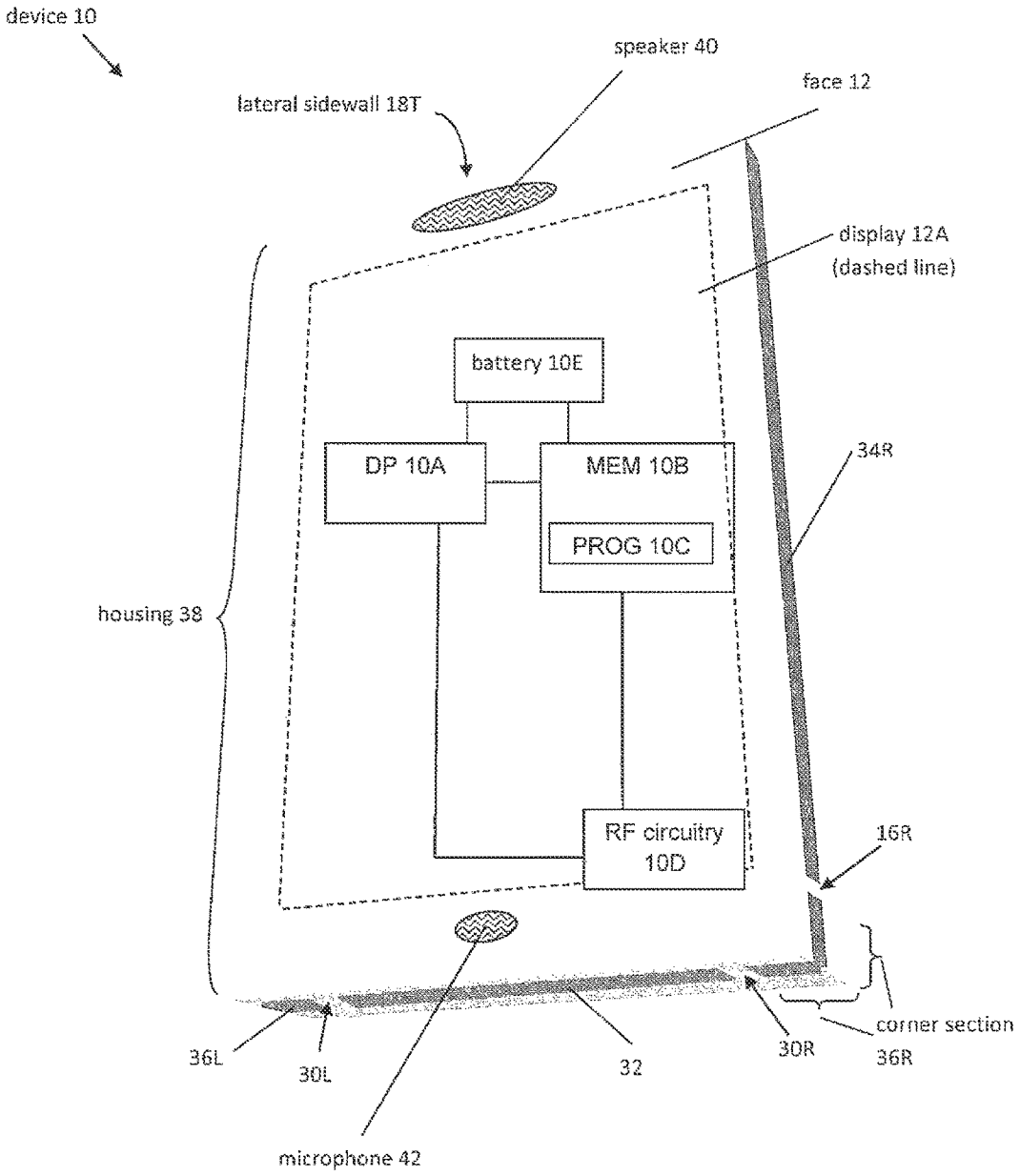
FIG. 6 is a perspective view of an electronic device incorporating the conductive strip along its sidewalls with four gaps and showing schematic electronic components therein according to an exemplary embodiment of these teachings.

FIG. 2A illustrates a cutaway plan view of a lower portion of an electronic device 10 according to these teachings. The FIG. 2A view is towards the face 12 of the device 10 which comprises a display 12A facing the user (see FIG. 6 for the face 12 and display 12A). Such a display may be a touch screen or an organic light emitting diode display, with physical or software-defined buttons for accepting a user input and a graphical user interface for providing visual information to the user. The face 12 forms a housing of the device 10 which is bounded by opposed longitudinal sidewalls 14L (left) and 14R (right), and also by opposed lateral sidewalls 18B (bottom) and 18T (top, which is shown at FIG. 6). The length of each longitudinal sidewall 14L, 14R which span between the opposed lateral sidewalls 18B, 18T is greater than the length of either lateral sidewall 18B, 18T which each span between the opposed longitudinal sidewalls 14L, 14R. Each intersection of a longitudinal sidewall with a lateral sidewall is termed a corner portion 36 (36R and 36L shown in FIG. 2A).

The device 10 of FIG. 2A also illustrates a ground plane 24 to which various electronic components within the device 10 are grounded. In some example embodiments, the ground plane 24 may be provided by a multi-layered printed wiring board (PWB) having at least one layer of the multi-layered PWB configured as a ground plane 24 by having a solid layer of conductive material, for example, copper. In other example embodiments, the ground plane 24 may be provided by one or more conductive components, for example in its most basic form a simple sheet of metal. Of particular relevance are the antenna elements 20A and 20B which are each coupled at a positive feed 26A, 26B to radio frequency (RF) circuitry 10D. The antenna elements 20A and 20B are monopole type elements. Some antenna elements such as inverted-F antennas (IFAs) need to also be coupled to ground via a further ground feed. Each of these antenna elements 20A, 20B are disposed in close proximity to the lateral sidewall 18B but not in physical or galvanic electrical contact therewith. The antenna elements 20A, 20B may be monopole, dipole, folded monopole, folded dipole, loop, IFA, PIFA (planar inverted-F antenna), PILA (planar inverted-L antenna) or any other type of antenna radiator. In an example embodiment where the antenna element 20A and/or 20B are antenna types which require a ground coupling line, then there would be an additional conductive coupling line between the RF feed 26A, 26B and the RF circuitry 10D. FIG. 2A illustrates only the RF feed coupling line between the RF feed 26A, 26B and the RF circuitry 10D. Antenna types which typically require a ground coupling line in addition to the RF feed coupling line can be a folded monopole, a folded dipole, a single-ended or unbalanced loop antenna, an IFA, and a PIFA, as non-limiting examples. Antenna types which typically require only a RF coupling line can be a monopole, a dipole, a balanced loop antenna, a PILA, as non-limiting examples. In the FIGS. 2A and 2B embodiments these are driven antenna elements, meaning they are directly excited by being directly connected to radio frequency circuitry or connected directly through matching components or other RF circuitry (switches, filters, phase shifters, transmission lines, as non-limiting examples) to the radio frequency circuitry 10D.

The longitudinal sidewalls 14L, 14R and also the lateral sidewall 18B shown at FIG. 2A are formed of a conductive metal strip and so these conductive strips are the structure of the sidewalls themselves. In an alternative disposition shown at FIG. 6 such a conductive metal strip may be attached to or patterned onto another material that forms the physical structure of these sidewalls. Along each of the longitudinal sidewalls 14L, 14R of FIG. 2A near the lateral sidewall 18B is a first gap 16L, 16R in that conductive strip. There are also two second gaps 30L, 30R along the lateral sidewall 18B. The corner portions 36L, 36R of the conductive strip which lie between each adjacent first and second gap (pairs 16L and 30L, and 16R and 30R) are electrically isolated from other portions of the strip, and from internal components of the device 10. Thus the lateral sidewall 18B, or lateral portion of the strip, runs between the two second gaps 30L/R. The driven antenna elements 20A, 20B are in close proximity to the lateral sidewall 18B such that this lateral portion of the strip acts as a parasitic element to those driven antenna elements 20A, 20B. The overall parasitic element comprises one or more ground conductor 22A and the portion of the conductive strip along the lateral sidewall 18B are configured to re-radiate power and can also be used to enhance the frequency bandwidth to provide broader radio coverage. In this manner the driven element(s) 20A, 20B, the ground conductor 22A, and the parasitic lateral portion of the strip along the lateral sidewall 18B interact with one another.

The longitudinal portions 14L/R of the strip above each first gap 16L/R may be one continuous strip and is electrically coupled to the ground plane 24 at one or more locations along its length. In another embodiment there may be additional portions of these longitudinal portions 14L/R of the conductive strip which, like the lateral portion 18B are isolated by further gaps from those grounded portions of the longitudinal strips, to also parasitically couple to other driven antenna elements located at other positions about the sidewalls. The conductive strip may fully circumscribe the housing along the sidewalls, with the exception of any gaps that isolate portions which electrically 'float' relative to the ground potential, or the strip may circumscribe less than the entire circumference of the housing. The gaps may be sufficiently large that air alone is a sufficient insulator that the intended portion(s) is electrically isolated from adjacent (grounded) portions of the conductive strip across the gap. In other embodiments there may be a dielectric material such as an insulating plastic disposed to fill the gap and better assure electrical isolation with a smaller gap width. In that respect, the corner sections may themselves be made of a non-conductive material such as plastic or some other electrical insulator. Or if the corner sections have their own conductive strip or are made from a metal or other conducting material as above, still they would be electrically floating since they are not electrically coupled in an operative way to circuitry inside the terminal housing.

In the FIG. 2A embodiment the lateral sidewall 18B is directly coupled to ground 24 via the ground conductors/direct contacts 22A shown, which together form the parasitic element. For completeness there is also shown an audio or USB port 28 at a conventional location centered along the bottom lateral sidewall 18B. This is also a typical location for a data port or a battery charging port. In a particular embodiment of these teachings such an audio or USB/data or charging port may be disposed at either or both positions of the second gap 30L/R. In a particular embodiment the second gap 30L/R may be disposed further along the lateral sidewall 18B towards the centre of the lateral sidewall 18B, thus creating a larger corner portion 36L/R. This may be advantageous in some operational frequency bands.

Figure 2B:
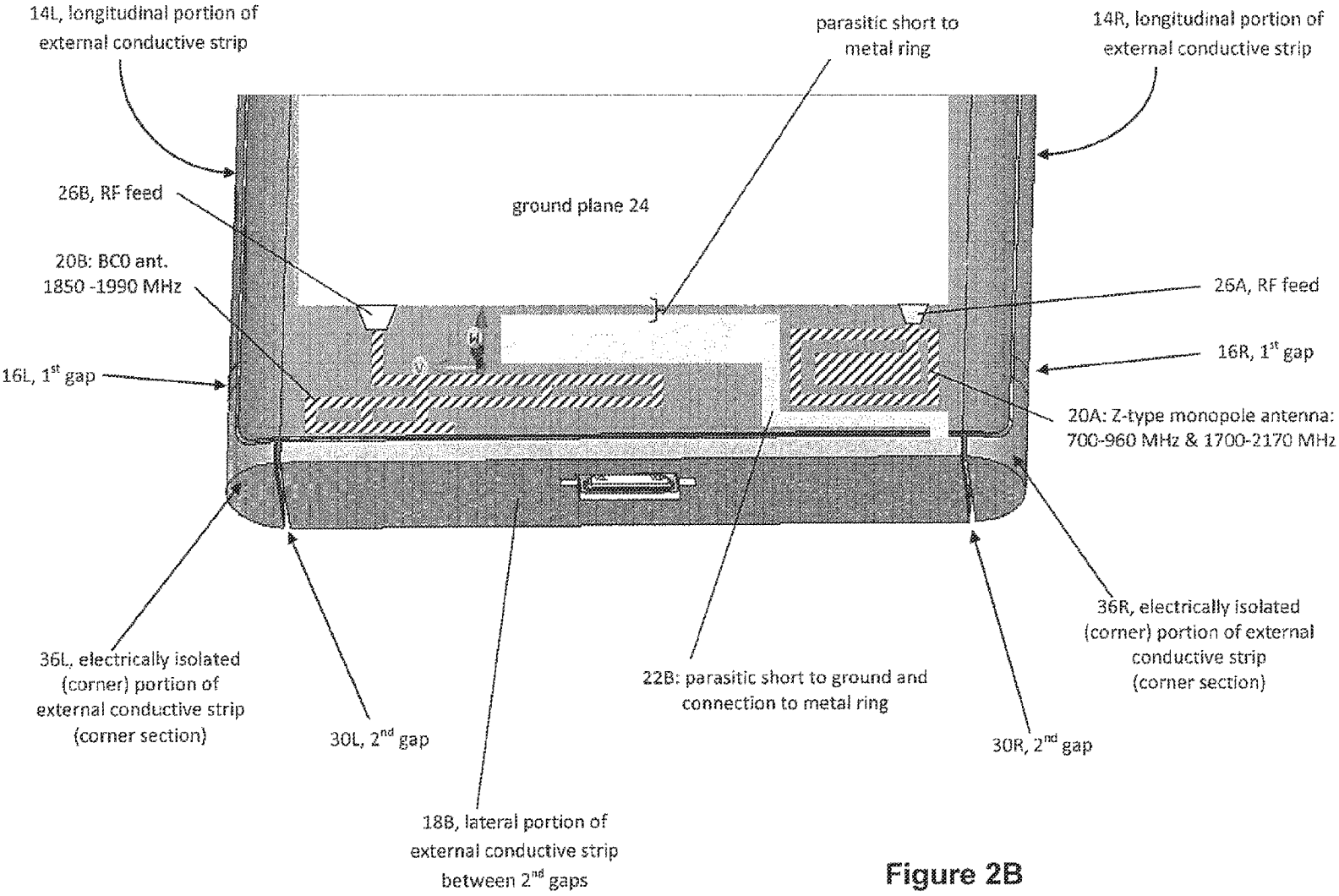
FIG. 2B is similar to FIG. 2A but with different antenna configurations and where the portion of the lateral sidewall between the additional two gaps is parasitically grounded to ground according to an exemplary embodiment of these teachings.

FIG. 2B is a view similar to FIG. 2A but with a different arrangement of two internal driven antenna elements 20A, 20B and the connection to ground of the lateral portion 18B of the conductive ring (the parasitic element which lies between the second gaps 30L, 30R). The two driven antenna elements 20A, 20B are shown more specifically; one 20A is a Z-type monopole antenna element resonant at both low 700-960 MHz and high 1700-2170 MHz GSM cellular bands and is directly connected to radio frequency (RF) circuitry at a first RF feed 26A; the other 20B is another monopole-type antenna element resonant at the high 1850-1990 MHz GSM cellular band. Also shown for the second antenna 20B is a second RF feed 26B which directly connects that antenna driven element 20B to its related radio frequency (RF) circuitry. While the conductive strip portions are the sidewalls in FIGS. 2A-B, in other embodiments this is not necessarily the case (as shown by example at FIG. 6). The lateral portion/sidewall 18B of the external conductive strip between the gaps 30L, 30R is parasitically coupled to the ground potential/ground plane 24 via a parasitic short/conductive portion 22B, rather than directly coupled to ground via the direct connections 22A shown at FIG. 2A. An open edge of the conductive portion 22B electromagnetically couples to the lateral edge of the ground plane 24 so that the parasitic element comprising the conductive portion 22B and the lateral sidewall 18B is grounded. The longitudinal portions/sidewalls 14L/14R of the external conductive strip are also shown, and the corner portions 36L/R of the strip are electrically isolated from their adjacent longitudinal portion 14L/R of the strip by the first gap 16L/R, and electrically isolated from their adjacent lateral portion 18B of the strip by their adjacent second gap 30L/R.

These four gaps 16L, 16R, 30L, and 30R shown at FIGS. 2A-B divide the external conductive strip into at least four sections. One lateral portion 32 is along the lateral sidewall 18B between the second gaps 30L and 30R; each of the two corner portions 36L and 36R lie between the second gap along the lateral sidewall and its adjacent gap along the longitudinal sidewall (between 30L and 16L and also between 30R and 16R), and if there are no further gaps in the portion of the device not shown in FIGS. 2A-B then the fourth portion is the longitudinal portion 14L that extends beyond the gap 16L and through the top lateral portion (18T, see FIG. 6) is continuous with the opposed longitudinal portion 14R.

FIG. 3 is similar to FIG. 1B but in which the user is holding the device of FIGS. 2A-B having four gaps. The user's finger bridges the same gap along the longitudinal sidewall as in FIG. 1B, but in this case the device has the additional gaps (or more generally electrical isolations) 30L and 30R along the lateral sidewall 18B which isolate any shorting by the user's finger across the longitudinal gap 16L (or 16R, not illustrated).

With reference to FIGS. 2A-B, this is because the four gaps create two 'islands' of floating external conductive housing at the corner portions 36L and 36R. These electrically floating 'islands' are located at the bottom corners of the device 10 in the illustrated embodiments because this is where the user's fingers tend to be located during a call. Capacitance from the user's finger is isolated by one or both of the electrically floating 'islands' 36L, 36R and so do not act to de-tune the driven antenna element 20A, 20B. The capacitance from the user's fingers is also distributed across one or both of the electrically floating 'islands' 36L, 36R thus spreading the capacitance across them. The two corner portions 36L, 36R provide a buffer zone between the antenna structure comprising the lateral sidewall 18B and the longitudinal portions 34L/34R. Because there are four gaps, then assuming the longitudinal portions 14L/R are not grounded but operate as antennas at other frequency bands there are four pieces of conductive housing sidewall that are electrically isolated from one another as noted above with reference to FIG. 2B. The lateral portion/lateral sidewall 18B between the gaps 30L, 30R is not floating electrically but instead acts with its ground conductor 22A, 22B as a parasitic element to the internal driven antenna element(s) 20A, 20B which are directly fed by RF circuitry at feeds 26A, 26B (FIGS. 2A-B). The lateral portion 18B of the conductive strip is coupled internally to the ground plane 24 in the illustrated embodiments to form a parasitic element, either directly as shown at FIG. 2A or parasitically as shown at FIG. 2B. The lateral portion 18B acts as the gateway for the RF signals in and out of the device 10 or overall antenna structure. Assuming that a man's thumb is no more than about 2.5 cm wide, the gaps 30L, 30R should be spaced from one another by at least that distance, and each adjacent pair of first and second gaps should also be spaced by at least that amount as measured about the corner portions 36L/R. A more robust disposition of the second gaps 30L/R is more toward the outboard corners as shown at FIGS. 2A-B, to mitigate any shorting from a user's thumb being disposed diagonally along the lateral sidewall 18B or even from a broad portion of the palm of the user's hand. In either case, mitigating these hand interferences improves the performance of the antenna in practical use cases.

A smaller width of the gap 30L, 30R might be considered to be more aesthetically pleasing to certain users, in which case these gaps can be on the order of 0.5 mm to 1.0 mm and filled with an insulator to assure electrical isolation from the adjacent corner portions 36L, 36R of the conductive strip. Alternatively, an audio port 28 (or similarly a data port or battery re-charge port/receptacle) can be disposed in the position of one or both of these second gaps 30L, 30R to serve the dual function of the relevant port/receptacle and electrical isolation of the lateral portion 32 from its adjacent corner portions 36L, 36R as noted above. Sharing the physical volume provided by the gaps 30L, 30R both the audio parameters and the antenna parameters may benefit from this combined arrangement, such that, for example, a microphone needing only less than one millimeter of space for the audio port and the antenna only requiring the same physical dimension for the antenna isolation, provides a mutually beneficial arrangement.

Figure 4A:
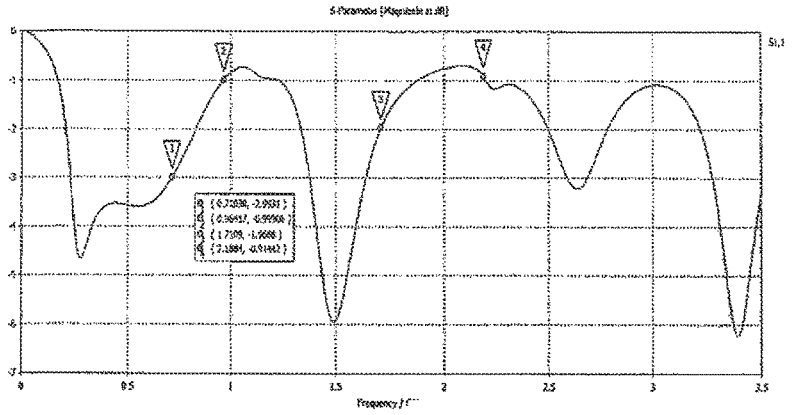
FIG. 4A is a graph illustrating antenna efficiency for various frequencies of the arrangement with gaps only in the longitudinal conductive strips shown at FIG. 1B and with a user's finger shorting out one of those gaps.
Figure 4B:
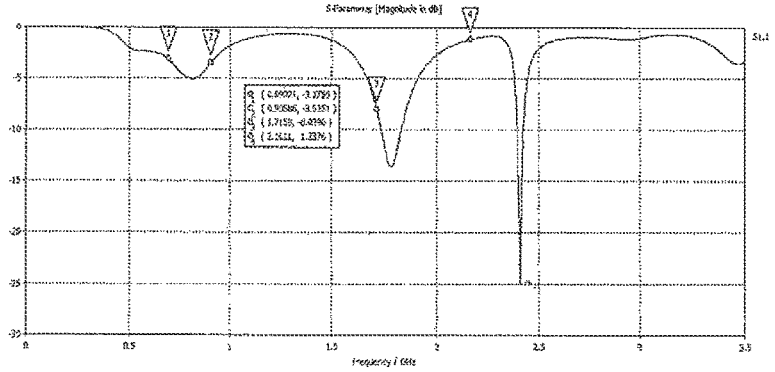
FIGS. 4B-C are similar to FIG. 4A of the arrangement with four gaps in the external conductive strips as shown at FIGS. 2A-B and with a user's finger shorting out the same gap as in FIG. 4A, for a gap width of 0.5 mm and 1.0 mm, respectively.
Figure 4C:
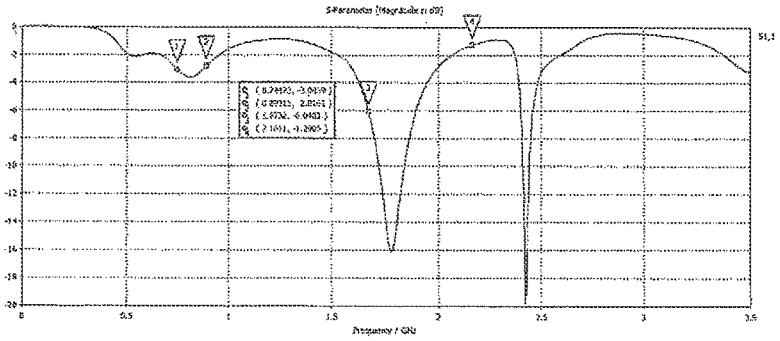

FIGS. 4A-C illustrate some quantitative data for comparison; the reader is cautioned to note the differing scales along the vertical axes among these data plots. FIG. 4A illustrates for the device of FIG. 1A-B with only two gaps in the external conductive strip and where a user's finger is completely shorting out of one of those gaps as is shown at FIG. 1B. The driven antenna element is detuned which results in a degradation of −10 dB or more for the antenna's s-parameter, S11 (antenna return loss).

FIGS. 4B-C illustrates the same antenna performance metrics but for the device of FIG. 2B with four gaps, and the user's finger completely shorting out the same first gap 16L. Note the scale differences at the left axes. The device 10 used for the data of FIG. 4B had second gaps measuring 0.5 mm across, while the device 10 used for the data of FIG. 4C had second gaps measuring 1.0 mm across. As can be seen both embodiments exhibit a greatly improved S11 parameter over FIG. 4A, but the greatest improvement is with the larger-width second gaps at FIG. 4C. The inventor tested a further embodiment with gaps having a width measuring 1.5 mm across and the efficiency was improved even further above FIG. 4C.

Figure 5A:
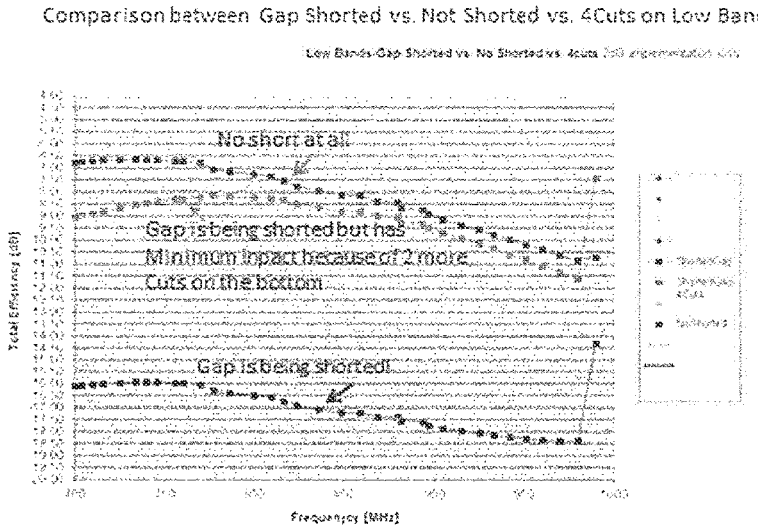
FIG. 5A is a graph comparing antenna total efficiency at low-band frequencies for an antenna in a mobile handset as in FIG. 1A which is not being shorted and which is being shorted, as compared to an antenna in a mobile handset with four gaps as in FIGS. 2A-B with the user's hand bridging one longitudinal gap.
Figure 5B:
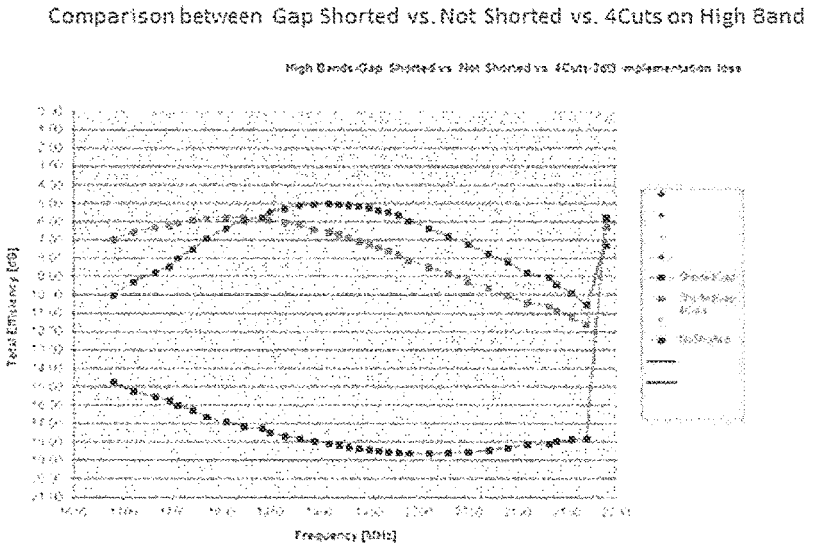
FIG. 5B is similar to FIG. 5A but for high-band frequencies.

FIGS. 5A-B also compare efficiencies of the antennas, but total efficiency. FIG. 5A plots for the low frequency band (700-960 MHz) and FIG. 5B for the high frequency band (1700-2170 MHz). The legends describe that the data plots along the top-most line of FIG. 5A are for the case in which the user's hand is not shorting across the first gap 16L; the lowermost line is the embodiment of FIG. 1B with two first gaps only and the user's hand shorting across the gap 16L, and the remaining plot line is for the four-gap embodiment of FIG. 2B also with the user's hand shorting across the same first gap 16L. The similar plot lines cross in FIG. 5B but the order is the same above 1900 MHz. FIGS. 5A-B illustrate a substantial advantage of the FIG. 2B embodiment as compared to that shown at FIGS. 1A-B.

FIG. 6 is a perspective view of an electronic device 10 incorporating the external conductive strip along its sidewalls and showing schematic electronic components therein according to an exemplary embodiment of these teachings. The portable electronic device 10 may for example be a mobile terminal/cellular telephone, personal digital assistant having wireless communication capabilities, image capture devices such as digital cameras having wireless communication capabilities, gaming devices having wireless communication capabilities, music storage and playback appliances having wireless communication capabilities, Internet appliances permitting wireless Internet access and browsing, as well as portable units or terminals that incorporate combinations of such functions. Tablet computers may also be held in one hand and are subject to similar hand interferences noted herein. These teachings may also be incorporated into other portable devices that are not necessarily held in a single hand, such as for example laptop and palmtop computers having wireless communication capabilities. These are non-limiting examples of the portable device 10. For orientation, the face 12 of the device is the largest surface shown at FIG. 6 and the graphical display 12A is shown via a dotted line on the face 12.

Different from FIGS. 2A-B, FIG. 6 shows the various conductive strip portions 34R, 36R, 32 and 36L made into or patterned onto the sidewalls but not forming the entire structure of the sidewalls themselves, as well as the opposed lateral sidewall 18T at the top of the device 10.

Whether as shown in FIG. 6 or in FIGS. 2A-B, the strip portions may be covered in a protective layer that is RF transparent and which may also be electrically insulating. More generally these conductive strip portions 34R, 36R, 32 and 36L may be referred to as conductive portions of the respective sidewalls, which encompasses the case in which the sidewalls are formed of the metal strip as in FIG. 2B and also the case where a conductive strip is affixed to but a separate and distinct entity from the structural sidewalls themselves as in FIG. 6.

FIG. 6 also shows that the two lateral sidewalls 18B, 18T may be distinguished at least in mobile terminal type devices 10 in that the top lateral sidewall 18T is nearer the speaker 40 than the microphone 42 and the bottom lateral sidewall 18B is nearer the microphone 42 than the speaker 40. It is preferable to dispose the driven antenna elements 20A, 20B nearer the bottom lateral sidewall 18B to minimize radiation to the user's head, and additionally to mitigate interference with the user's hand when transmitting and receiving.

Internal of the overall housing 38 the device 10 is RF circuitry 10D such as for example a transmitter and/or a receiver, which may or may not be embodied as a single transceiver and which may or may not be disposed on what is known as a RF front end chip. It is this RF circuitry 10D which connects to the RF feed point(s) 26A, 26B shown at FIGS. 2A-B. The device 10 includes one or more computer readable memories MEM 10B which stores various programs PROG 10C for operating the device's functions and signaling protocols. These internal processes are all controlled by one or more processors, such as the digital processor DP 10A. In many embodiments there will be multiple task-specific processors slaved in at least timing to a main central processing unit CPU; the DP 10A represents any and all of these. All the internal components draw electrical energy from a battery 10E when the device 10 is portable.

The computer readable MEM 10B may be of any type suitable to the local technical environment and may be implemented using any suitable data storage technology, such as semiconductor based memory devices, flash memory, magnetic memory devices and systems, optical memory devices and systems, fixed memory and removable memory. The DP 10A may be of any type suitable to the local technical environment, and may include one or more of general purpose computers, special purpose computers, microprocessors, digital signal processors (DSPs) and processors based on a multicore processor architecture, as non-limiting examples. The battery 10E may for example be a galvanic battery or a fuel cell.

To summarize some of the above teachings then, an apparatus according to exemplary embodiments of these teachings comprises a housing 38 defining a face 12 bounded by opposed longitudinal sidewalls 14L, 14R and opposed lateral sidewalls 18B, 18T. At least one conductive portion 34L, 34R of at least one of the longitudinal sidewalls 14L, 14R is electrically isolated from at least one conductive portion 32 of at least one of the lateral sidewalls 18B by non-conductive first and second gaps that define corner sections. This exemplary apparatus further includes at least one antenna element 20A, 20B internal to the housing 38, which is electrically coupled to radio frequency circuitry 10D. There is additionally a conductor 22A, 22B configured to electrically couple the at least one conductive portion 32 of the at least one lateral sidewall 18B, 18T to a ground plane 24, where the at least one lateral sidewall 18B, 18T is disposed between the corner sections 36L, 36R.

In one particular embodiment above, the conductive portion 32 of the at least one lateral sidewall 18B lies between the two second non-conductive gaps 30L, 30R, which are spaced from one another by at least 2.5 cm. Preferably also the span about the corner section between the lateral conductive portion 32 and each adjacent longitudinal conductive portions 34L, 34R is at least 2.5 cm. In another exemplary embodiment each of the corner sections comprises a corner conductive portion 36L, 36R which is isolated from its adjacent longitudinal conductive portion 34L, 34R and lateral conductive portion 32 such that the corner conductive portions are configured to be electrically floating, in other words the corner conductive portions are not galvanically connected to ground potential or any other electrical signal potential, positive or negative. In the example embodiments, at least one antenna element 20A, 20B is disposed relative to the lateral conductive portion 32 between the corner sections (between the two second non-conductive gaps 30L, 30R) so as to parasitically couple thereto during operation.

In certain example embodiments the various conductive portions are formed of an external (or internal) conductive strip which fully circumscribes the housing, apart from the non-conductive gaps. In this or other example embodiments at least one of the longitudinal conductive portions 34L, 34R is configured to electrically connect to the ground plane 24.

Any of these above embodiments may be further characterized in having at least two antenna elements 20A, 20B internal to the housing 38 and configured to couple to radio frequency circuitry 10D. In this embodiment, each of those antenna elements 20A, 20B is disposed adjacent to the lateral conductive portion 32 between the corner sections 30L/R, where one of the antenna elements 20B is configured to resonate between about 700-960 MHz and the other of the driven antenna elements 20A is configured to resonate above 1700 MHz. As shown at FIG. 2B each of those antenna elements 20A, 20B are disposed relative to the lateral conductive portion 32 between the corner sections 36L, 36R so as to parasitically couple thereto. And above it was also detailed in the non-limiting drawings that the housing 38 was for a mobile handset radio device.

In any of the above embodiments of this invention it should be understood that the words "couple" and "connect" mean that the features being connected or coupled are operationally connected or coupled, including any derivatives of these words. It should also be appreciated that the connection or coupling may be a physical galvanic coupling or connection, and/or an electromagnetic non-galvanic coupling or connection. It should also be appreciated that any number or combination of intervening components can exist (including no intervening components) between the features which are coupled or connected together. Above the terms direct and parasitic were used to distinguish specific types of electrical connections; direct meaning a galvanic type of connection and parasitic meaning a non-galvanic type of electromagnetic connection.

Various modifications and adaptations to the foregoing example embodiments of this invention may become apparent to those skilled in the relevant arts in view of the foregoing description, when read in conjunction with the accompanying drawings. However, any and all modifications will still fall within the scope of the non-limiting and example embodiments of this invention.

Furthermore, some of the features of the various non-limiting and example embodiments of this invention may be used to advantage without the corresponding use of other features. As such, the foregoing description should be considered as merely illustrative of the principles, teachings and example embodiments of this invention, and not in limitation thereof.

I claim:

1. An apparatus comprising:

a housing defining a face bounded by opposed longitudinal sidewalls and opposed lateral sidewalls, wherein the housing comprises at least one corner section that is non-conductive or electrically floating at an intersection of at least one of the longitudinal sidewalls with at least one of the lateral sidewalls, and at least one conductive portion of at least one of the longitudinal sidewalls and at least one conductive portion of at least one of the lateral sidewalls are configured to be electrically isolated from the at least one corner section;

at least one antenna element internal to the housing, and configured to electrically couple to radio frequency circuitry; and a conductor configured to electrically couple the at least one conductive portion of the at least one of the lateral sidewalls to a ground plane, wherein the at least one conductive portion of the at least one lateral sidewall is disposed between the opposed longitudinal sidewalls and wherein the at least one conductive portion of the at least one longitudinal sidewall is configured to be electrically coupled to the ground plane.

2. The apparatus according to claim 1, wherein:

at least one conductive portion of each of the longitudinal sidewalls is configured to be electrically isolated from the at least one conductive portion of the at least one of the lateral sidewall by opposed non-conductive or electrically floating corner sections, each corner section defined by non-conductive first and second gaps.

3. The apparatus according to claim 2, wherein each of the corner sections comprises a corner conductive portion which is isolated from adjacent conductive portions of the at least one longitudinal sidewall and the at least one lateral sidewall by the non-conductive first and second gaps such that the corner conductive portions are configured to be electrically floating.

4. The apparatus according to claim 2, wherein the at least one antenna element is disposed relative to the at least one conductive portion of the at least one lateral sidewall between the corner sections so as to parasitically couple thereto.

5. The apparatus according to claim 2, wherein each of the at least one conductive portion of the at least one longitudinal sidewall and the at least one conductive portion of the at least one lateral sidewall comprises an external conductive strip which circumscribes the housing apart from the non-conductive gaps.

6. The apparatus according to claim 2, further comprising at least two antenna elements internal to the housing and configured to couple to radio frequency circuitry, each of the antenna elements disposed adjacent to the at least one conductive portion of the at least one lateral sidewall between the corner sections.

7. The apparatus according to claim 6, wherein one of the antenna elements is configured to resonate between about 700-960 MHz and the other of the antenna elements is configured to resonate above 1700 MHz.

8. The apparatus according to claim 6, wherein each of the at least two antenna elements are disposed relative to the at least one conductive portion of the at least one lateral sidewall between the corner sections so as to parasitically couple to the at least one conductive portion of the at least one lateral sidewall.

9. The apparatus according to claim 1, wherein the at least one conductive portion of the at least one longitudinal sidewall is configured to be electrically coupled to the ground plane.

10. The apparatus according to claim 1, wherein the apparatus comprises a portable electronic device.

11. A method comprising:

providing a housing defining a face bounded by opposed longitudinal sidewalls and opposed lateral sidewalls, wherein the housing comprises at least one corner section that is non-conductive or electrically floating at an intersection of at least one of the longitudinal sidewalls with at least one of the lateral sidewalls, and at least one conductive portion of at least one of the longitudinal sidewalls and at least one conductive portion of at least one of the lateral sidewalls are configured to be electrically isolated from the at least one corner section;

electrically coupling at least one antenna element internal to the housing to radio frequency circuitry; and disposing a conductor to electrically couple the at least one conductive portion of the at least one lateral sidewall between the opposed longitudinal sidewalls to a ground plane, wherein the at least one conductive portion of the at least one lateral sidewall is disposed between the opposed longitudinal sidewalls and wherein the at least one conductive portion of the at least one longitudinal sidewall is configured to be electrically coupled to the ground plane.

12. The method according to claim 11, wherein:

the housing comprises at least one conductive portion of each of the longitudinal sidewalls that is electrically isolated from the at least one conductive portion of the at least one lateral sidewall by opposed non-conductive or electrically floating corner sections, each corner section defined by non-conductive first and second gaps.

13. The method according to claim 12, wherein each of the corner sections comprises a corner conductive portion which is isolated from its adjacent conductive portions of the at least one longitudinal sidewall and of the at least one lateral sidewall by the non-conductive first and second gaps such that the corner conductive portions are configured to be electrically floating.

14. The method according to claim 12, wherein the at least one antenna element is disposed relative to the at least one conductive portion of the at least one lateral sidewall between the corner sections so as to parasitically couple thereto.

15. The method according to claim 12, wherein the at least one conductive portion of the at least one longitudinal sidewall and the at least one conductive portion of the at least one lateral sidewall comprises an external conductive strip which circumscribes the housing apart from the non-conductive gaps.

16. The method according to claim 12, wherein electrically coupling the at least one antenna element comprises electrically coupling at least two antenna elements internal to the housing to the radio frequency circuitry, each of the antenna elements disposed adjacent to the at least one conductive portion of the lateral sidewall between the corner sections.

17. The method according to claim 16, wherein one of the antenna elements is configured to resonate between about 700-960 MHz and the other of the antenna elements is configured to resonate above 1700 MHz.

18. The method according to claim 16, wherein each of the at least two antenna elements are disposed relative to the at least one conductive portion of the at least one lateral sidewall between the corner sections so as to parasitically couple to the at least one conductive portion of the at least one lateral sidewall.

19. The method according to claim 11, further comprising:

electrically coupling the at least one conductive portion of the at least one longitudinal sidewall to the ground plane.

20. The method according to claim 11, wherein the housing is for a portable electronic device.

* * * * *